US005218329A

United States Patent [19]

Vangala et al.

[11] Patent Number: 5,218,329

[45] Date of Patent: Jun. 8, 1993

[54] LOW PROFILE CERAMIC FILTER WITH SELF ALIGNING SHIELD

[75] Inventors: Reddy R. Vangala, Albuquerque, N. Mex.; Truc G. Hoang, San Diego, Calif.

[73] Assignee: Motorola, Inc., Schaumburg, Ill.

[21] Appl. No.: 857,355

[22] Filed: Mar. 25, 1992

[51] Int. Cl.[5] ..... H01P 1/205

[52] U.S. Cl. ..... 333/206; 333/222

[58] Field of Search ..... 333/202, 206, 207, 222, 333/223, 243

[56] References Cited

U.S. PATENT DOCUMENTS 5,130,683 7/1992 Agahi-Kesheh et al. ..... 333/206 X

FOREIGN PATENT DOCUMENTS 0073801 4/1987 Japan ..... 333/202
0137901 6/1987 Japan ..... 333/222
0306701 12/1988 Japan ..... 333/202
0181205 8/1991 Japan ..... 333/202

*Primary Examiner*—Robert J. Pascal
*Assistant Examiner*—Seung Ham
*Attorney, Agent, or Firm*—Joseph P. Krause

[57] ABSTRACT

A dielectric block filter having a self aligning, top and shield is provided. Recesses are formed in at least one side of the block, which recess is dimensioned to accept a mating tab or side of a shield that substantially encloses the top end of the filter. The recess in the block in combination with the appropriately shaped tab produces the overall height of the filter and simplifies manufacturing by eliminating the need to hold or affix the shield to otherwise smooth sides of the block.

8 Claims, 2 Drawing Sheets

LOW PROFILE CERAMIC FILTER WITH SELF ALIGNING SHIELD

FIELD OF THE INVENTION

This invention relates to electrical filters. In particular, this invention relates to ceramic block filters.

BACKGROUND OF THE INVENTION

Ceramic block filters have become very popular for a variety of reasons including their small size, superior performance over lumped elements, and their manufacturability. Most ceramic block filters are comprised of parallelepiped blocks of dielectric material through which at least one hole extends. The surfaces of the block, including the inner surface of the hole or holes, with the exception of the top surface, are coated with a metallic or other conductive material. The conductive material lining the hole, in combination with conductive material coating the block, is electrically equivalent to a shorted length of transmission line of specific electrical length at some particular frequency.

Many of these block filters, the top surfaces of which are substantially uncoated, use printed capacitors on this top surface to control the frequency characteristics of this filter. These capacitors are typically formed by appropriately patterning conductive material on the top surface such that conductive areas that are spaced from one another on the top surface form capacitances the values of which, albeit small, can be used to adjust the bandpass or cutoff frequency of the filter.

It is well known that the top or open circuit end of the coaxial resonators in a block resonator have strong electric fields radiating therefrom which electric field may adversely affect circuitry surrounding the filter in a radio or other communication device. In conventional filters, (i.e., lumped-element filters using discreet inductors, resistors and capacitors) electric field radiation is minimized by enclosing the filter components in a metal housing which housing is typically coupled to the ground or reference potential for the circuit. In prior art block filters, electrical field radiation from a block filter is reduced by enclosing or otherwise confining the open or top surface of the filter in a metal bracket which is typically attached to the smooth exterior sides of the block by soldering. So-called surface mount block filters use an "L" or "U" shaped metal shield to contain the radiation.

While a bracket can provide effective shielding of electric fields emitted from the open or top surface of the block filter, it is difficult to attach to an otherwise smooth surface of the block and it also adds to the height and overall size of the filter because the shield uses the blocks outer edges for alignment while it is being soldered to the block.

In many radio communication devices, such as small low profile portable cellular telephones lightweight and compact size are becoming increasingly more popular in the market. Frequently, the thickness of such a unit is determined at least in part by the height and size of the ceramic filters on the circuit boards that comprise the phone. A low profile, surface mount ceramic block filter that minimizes the height associated with a shielded filter, and eases the assembly and manufacturing of such a filter would be an improvement over the prior art.

SUMMARY OF THE INVENTION

There is provided a dielectric block filter having a self-aligning top-end shield for reducing emitted radiation from the filter. The filter is comprised of a block of dielectric material having at least one hole extending through it. A small, shallow recess is formed in one side of the block to receive a mating planar tab that forms one side of a shield. The shield, which in its simplest embodiment would include a planar tab side and a substantially planar top is formed such that the tab resides in and mates with the recess formed in the side of the block.

The dimensions of the recess in the side of the block and the dimensions of the tab side of the shield, control the height of the top surface of the shield above the top surface of the block. Metallization on the exterior surfaces of the block permit the shield to be electrically connected to the metallization and to the ground or reference potential for the circuit thereby providing an effective electric shield.

DESCRIPTION OF A PREFERRED EMBODIMENT

Figure 1:
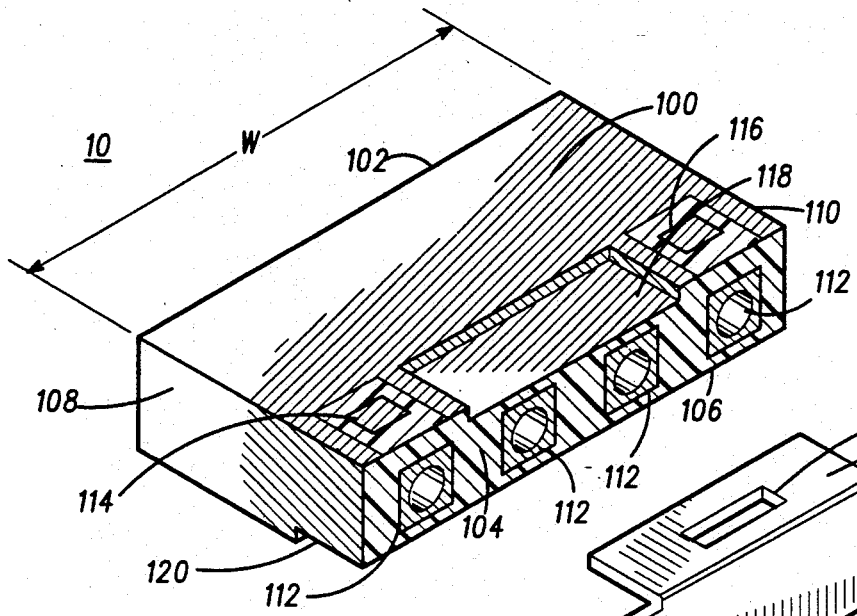
FIG. 1 shows a perspective view of a block filter that shows recesses in its sides.
Figure 2:
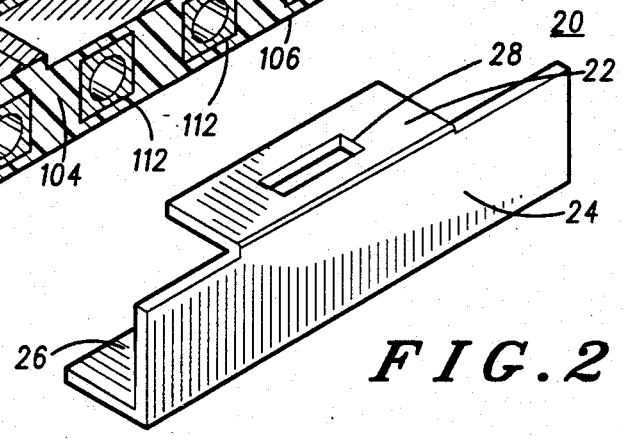
FIG. 2 shows a shield formed to mate with the recesses in the block filter shown in FIG. 1.

FIG. 1 shows a perspective view of a dielectric block filter (10), which in combination with the shield (20) shown in FIG. 2 comprises a block filter having a self-aligning, top-end shield for reducing emitted radiation. In FIG. 1, the block (10) is comprised of an appropriate dielectric material (which materials are well-known in the art) and has at least top (104), bottom (102), and side surfaces (100, 108, 106, and 110). Although the block shown in FIG. 1 has four holes (112) which extend completely through the block (10), which holes extend between the top surface (106) and the bottom surface (102), a block filter must have at least one hole through it that electrically forms a length of shorted transmission line.

The interior surfaces of the holes (112) as well as the exterior surfaces of the block, (with the exception of the top surface (106), are substantially covered with a conductive material. The metallization lining the holes (112) in combination with the metallization lining the exterior of the block, which is typically grounded, forms a transmission line that is shorted to the exterior metallization (which is grounded) at the bottom end (102) of the block (10).

Conductive material lining the interior surfaces of the holes (112) at the top end (104) is electrically open circuited while at the bottom end of the block (102) the conductive material lining the holes (112) is electrically short circuited to the metallization on the exterior surfaces of the block. It is well known that the metallization of the holes (112) in combination with the metallized exterior surfaces of the block (with the exception of the top surface which is not metallized) form coaxial resonators that are electrically equivalent to length of short circuited transmission line.

Capacitors are frequently formed on the top surface (104) by means of patterns of conductive material (105) that are deposited on to the top surface (104) of the block. These patterns (105) of material in some filter embodiments might not be required, but in most block filters are used to change the frequency characteristic of the filter by adding a so-called top loading effect.

An input/output pad (114 and 116) on the top surface (100) provides a means for coupling signals into the resonators comprised of the metallized holes of the block when the block (10) is appropriately mounted onto a circuit board. The input/output pads shown (114 and 116) are suitable for use with a surface mount block filter by virtue of the fact that when the block filter is placed top surface (100) down on to a circuit board, these input/output pads (114 and 116) can mate with and couple to conductive traces on to a circuit board.

Figure 3:
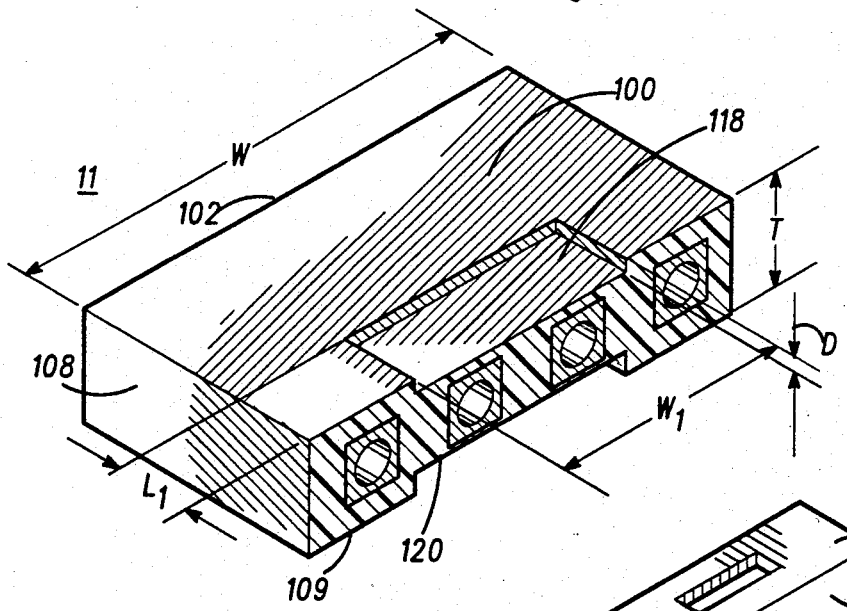
FIG. 3 shows a perspective view of an alternate embodiment of the block filter shown in FIG. 1.

A first recess (118) is formed in the top surface (100) of the block (10) which recess (118), as shown in FIG. 3, has a depth O, a width W, and a length $L_1$. Still referring to FIG. 1, the top or first recess (118) is sized and formed in the top side or upper surface (100) of the block (10) to receive a mating planar tab of a shield.

Turning to FIG. 2, there is depicted an isometric view of a shield (20) that is preferably comprised of a bent, or folded, piece of metal, which shield (20) is comprised of a planar tab side (22), a substantially planar top (24) and a second substantially planar tab side (26). A window (28) in the first planar tab side (22) is formed in this tab side (22) to facilitate soldering or other means of fixing the shield (20) to the block depicted in FIG. 1. Alternate shields might use only one tab side (22) and the top side (24).

Returning to FIG. 1 it should be noted that the block (10) includes a second recess (120) formed in the lower or bottom surface (106) of the block (10) which second recess (120) is on a surface opposing the first recess (118). While the second recess (120) may not be required in many instances, use of such a second recess can provide a more durable attachment of the shield (20) to the block (10). While a minimum of one recess is needed to provide the advantages of the invention, i.e., the self-alignment of the shield (20) with respect to the top surface (106) of the block, using a second recess to accommodate the second planar tab side (26) of the shield (20) shown in FIG. 2 might also improve electrical shielding as the top surface is more completely enclosed by conductive material.

Figure 4:
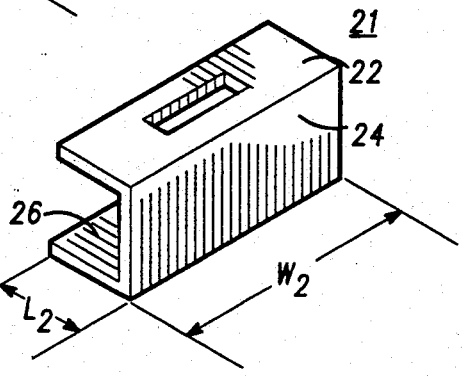
FIG. 4 shows a perspective view of a shield formed to mate with the recesses in the block filter shown in FIG. 3.

FIG. 3 shows an alternate embodiment of a dielectric block filter having a self-aligning, top-end shield. The block shown in FIG. 3, like the block shown in FIG. 1, is a parallelepiped having four holes that extend through the block intersecting the top and bottom surfaces. Like the block shown in FIG. 1, the block shown in FIG. 3 has a width W, a thickness T, and first and second recesses (118 and 120) in the top surface of the block (100) and the bottom surface (the bottom surface is not shown for clarity). As shown in FIG. 3, the recess (118) as well as the recess (120) has a width $W_1$ a depth D and a length $L_1$ as shown. The dimensions of the recesses are chosen such that the shield (21) shown in FIG. 4 can reside substantially within the recesses (118 and 120) with little or no extension of the material comprising the shield (21) above the surfaces (100) and the bottom surface (109) of the block.

Figure 5:
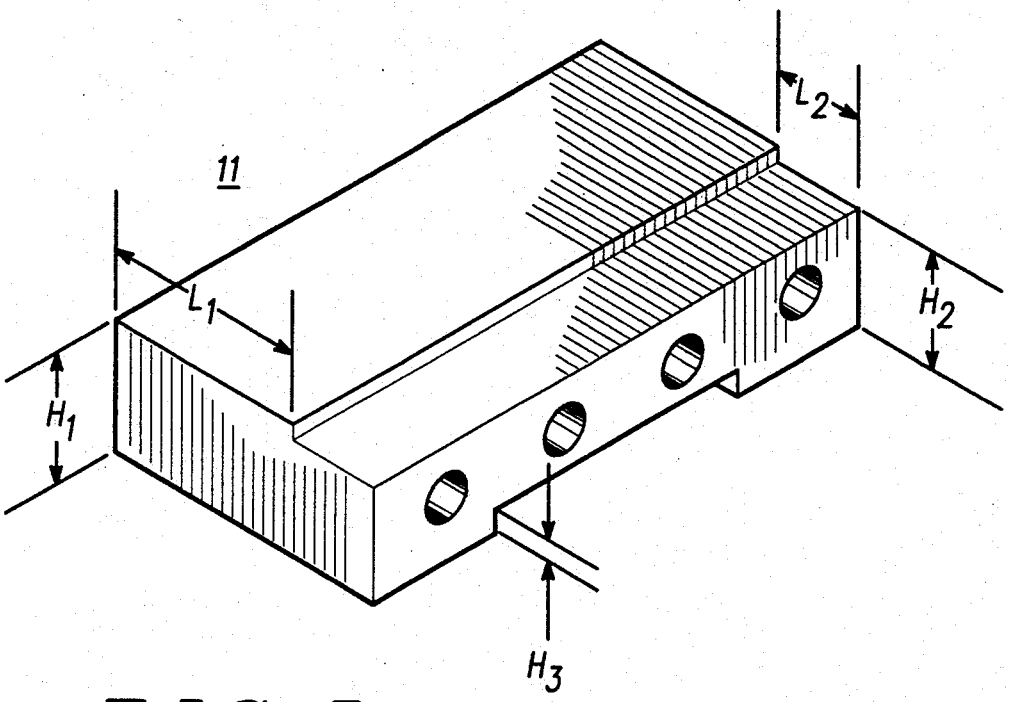
FIG. 5 shows a block filter that includes recesses in its sides to accommodate a shield.
Figure 6:
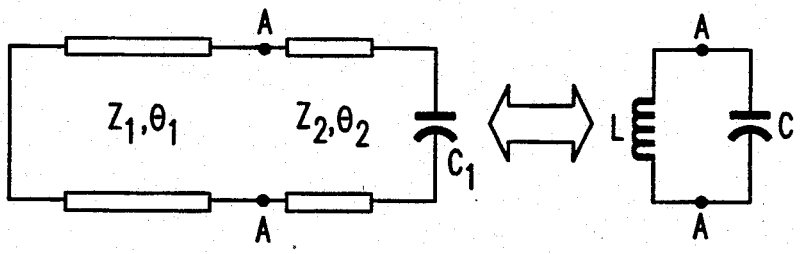
FIG. 6 shows an electrical equivalent circuit diagram of the block shown in FIG. 5.

Of course the presence of the steps or recesses (118 and 120) in the ceramic block, must be taken into consideration in designing the block length, spacing between the holes, and the required capacitive loading on the open or top end of the block (104). The step to block shown in FIG. 5 has an equivalent circuit as shown in FIG. 6. Each resonator in the step block is represented by a short circuited stub of electrical length $\theta_1$ and impedance $Z_1$, which is connected to a lumped capacitor $C_1$ through a transmission line section whose electrical length $\theta_2$ and impedance $Z_2$ as shown in FIG. 6. If lossless transmissions lines are assumed the following equations predict the resonant behavior of the block filter.

$$\text{Resonant Frequency } F_0 = \frac{1}{2\pi \cdot \sqrt{LC}}$$

$$\text{where } L = \frac{Z_1 \tan\theta_1}{\omega} \text{ henrys,}$$

$$\text{and } C = \left(\frac{1}{\omega Z_2}\right)\left(\frac{Z_2 \omega C_1 + \tan\theta_2}{1 - \omega C_1 Z_2 \tan\theta_2}\right) \text{farads}$$

$$\text{and } \omega = 2\pi f \text{ radians.}$$

By using the recesses formed in the sides of the block, and by appropriately selecting the dimensions for the tabs of the shield, a shield can be mounted or attached to the block such that precise alignment of it is controlled by the recesses themselves, and the height of the shield above the top surface is equally controlled thereby simplifying the manufacturing of a shielded dielectric block filter.

What is claimed is:

1. A dielectric block filter having a self-aligning top-end shield for reducing emitted radiation, said filter comprised of:

a block of dielectric material having top, bottom, and side external surfaces and having at least one hole extending through said top and bottom surfaces, interior surfaces of said block formed by said hole and with the exception of said top surface said exterior surfaces being substantially covered with conductive material;

a first recess formed in a first one of said side surfaces to receive a mating, substantially planar tab, said first recess having a depth, length, and width;

a shield comprised of at least a substantially planar tab side and a top, said substantially planar tab side having a thickness, length, and width and being formed to be accepted into said recess, said top surface substantially enclosing said top surface of said block when said tab side is mounted to said block.

2. The apparatus of claim 1 where said block is a parallelepiped and said recess is formed in a side surface of said parallelepiped.

3. The apparatus of claim 2 further including a second recess formed in a second side surface of said parallelepiped, said second surface opposing said first side surface.

4. The apparatus of claim 3 where said shield is comprised of a substantially planar top side and at least first and second substantially planar tab sides orthogonal to said to said top side, said tab sides being formed to mate with said first and second recesses.

5. The apparatus of claim 1 further comprised of first and second electrically isolated input-output pads located on said first one of said side surfaces.

6. The apparatus of claim 3 further comprised of first and second electrically isolated input-output pads located on at least one of said first and second side surfaces.

7. A dielectric block filter having a self-aligning top-end shield for reducing emitted radiation, said filter comprised of:

a block of dielectric material having top, bottom, and side external surfaces and having at least one hole extending through said top and bottom surfaces, interior surfaces of said block formed by said hole and with the exception of said top surface said exterior surfaces being substantially covered with conductive material;

a first recess formed in a first one of said side surfaces to receive a mating, substantially planar tab, said first recess having a depth, length, and width;

a second recess formed in a second one of said side surfaces to receive a mating, substantially planar tab, said second side surface opposing said first side surface, said second recess having a depth, length, and width;

a shield comprised of at least first and second substantially planar tab sides and a top orthogonal to said tab sides, each of said substantially planar tab sides having a thickness, length, and width and being formed to be accepted into said first and second recess, said top surface substantially enclosing said top surface of said block when said tab side is mounted to said block.

8. The apparatus of claim 7 further comprised of first and second electrically isolated input-output pads located on at least one of said first and second side surfaces.

* * * * *